US008408172B2

(12) United States Patent
Rohe et al.

(10) Patent No.: US 8,408,172 B2
(45) Date of Patent: Apr. 2, 2013

(54) HIGH EFFICIENCY LIFT PROFILER FOR AN INTERNAL COMBUSTION ENGINE

(75) Inventors: Jeffrey D. Rohe, Caledonia, NY (US); Jongmin Lee, Pittsford, NY (US)

(73) Assignee: Delphi Technologies, Inc., Troy, MI (US)

( * ) Notice: Subject to any disclaimer, the term of this patent is extended or adjusted under 35 U.S.C. 154(b) by 308 days.

(21) Appl. No.: 12/821,210

(22) Filed: Jun. 23, 2010

(65) Prior Publication Data

US 2011/0061618 A1 Mar. 17, 2011

Related U.S. Application Data

(60) Provisional application No. 61/242,211, filed on Sep. 14, 2009.

(51) Int. Cl.
*F01L 1/34* (2006.01)

(52) U.S. Cl. ..... 123/90.16

(58) Field of Classification Search ..... 123/90.15, 123/90.16

See application file for complete search history.

(56) References Cited

U.S. PATENT DOCUMENTS

| | | | | |
|---|---|---|---|---|
| 6,823,826 | B1 | 11/2004 | Sugiura et al. | |
| 7,225,773 | B2 | 6/2007 | Schleusener et al. | |
| 7,246,578 | B2 | 7/2007 | Nakamura et al. | |
| 7,814,873 | B2 * | 10/2010 | Tateno et al. | 123/90.16 |
| 7,909,006 | B2 * | 3/2011 | Tateno et al. | 123/90.16 |
| 2003/0132813 | A1 | 7/2003 | Gottschalk et al. | |
| 2009/0288623 | A1 * | 11/2009 | Lee et al. | 123/90.16 |
| 2010/0059006 | A1 * | 3/2010 | Maehara | 123/90.17 |

* cited by examiner

*Primary Examiner* — Thomas Denion
*Assistant Examiner* — Daniel Bernstein
(74) *Attorney, Agent, or Firm* — Thomas N. Twomey

(57) ABSTRACT

A system for varying actuation of a combustion valve in an internal combustion engine, including a control shaft pivot housing fixedly disposed on the engine, a control shaft pivotably disposed within the control shaft pivot housing and eccentrically fixed to a control shaft disc, an input rocker subassembly pivotably disposed on the control shaft disc and having a contact feature disposable as a follower against a camshaft lobe, an output cam subassembly pivotably disposed on the control shaft and engageable by the input rocker subassembly and including an output cam profile for engaging a finger follower of the engine, and a bias spring to urge the output cam subassembly toward the input rocker subassembly. In one aspect of the invention, high lift events with full duration are produced whenever the control shaft is aligned such that the input rocker pivot center and the output cam pivot center are coincidental.

19 Claims, 5 Drawing Sheets

HIGH EFFICIENCY LIFT PROFILER FOR AN INTERNAL COMBUSTION ENGINE

RELATIONSHIP TO OTHER APPLICATIONS AND PATENTS

This application claims the benefit from U.S. Provisional Application Ser. No. 61/242,211, filed on Sep. 14, 2009.

TECHNICAL FIELD

The present invention relates to Variable Valvetrain Actuation (VVA) devices for varying the lift of combustion valves in an internal combustion engine; more particularly, to such devices for varying the lift, duration, and phasing of such valves; and most particularly, to such devices employing a single rotary actuator, referred to herein as a High Efficiency Lift Profiler (HELP) system.

BACKGROUND OF THE INVENTION

When compared to competitive VVA devices, the main advantages of the present HELP system are its simplicity and compact height. The VVA device disclosed in US Patent Application Publication No. 2003/0132813 A1 and U.S. Pat. No. 7,246,578 B2 are kinematically complex, adding four to six oscillating members per cylinder to conventional, direct acting and roller finger follower valvetrains, respectively. The greater the number of oscillating parts, the less stiff the system is dynamically and the less likely it is to obtain satisfactory high speed operation. This can be seen in these VVA devices' undesirable phase change characteristic in full lift as a function of engine speed.

Although the VVA device disclosed in U.S. Pat. No. 6,823,826 B1 offers an attractive packaging height, it is very complex as well. Moreover, with its internally and externally splined parts, it is a costly and noisy solution for varying valve lift.

In the present HELP system, only two oscillating members have been added to a standard, roller finger follower type valvetrain system to effect variations in lift, timing, and duration. By comparison, while the VVA device disclosed in U.S. Pat. No. 7,225,773 B2 also is kinematically simple with only two added parts per cylinder, the system adds considerable height to an engine.

Having fewer moving parts also simplifies the design tradeoffs associated with these mechanical devices. In the VVA device disclosed in U.S. Pat. No. 5,937,809, an input rocker is connected through a link to two output cams that also ride on the input camshaft. Because the mechanism comprises four moving parts per cylinder, it is difficult to provide a return spring stiff enough for high-speed engine operation that will still fit within the available packaging space. Since the present HELP system has only two moving parts, the total mass moment of inertia is much lower, and hence spring design is less challenging. In addition, because there are fewer parts, there are fewer degrees of freedom in the mechanism, which simplifies the task of design optimization to meet performance criteria by substantially reducing the number of equations required to describe the mechanism's motion.

As the cost of petroleum continues to fluctuate from increased global demands and limited supplies, the fuel economy benefits of internal combustion engines will become a central issue in their design, manufacture, and use at the consumer level. Production applications that apply a continuously variable valvetrain system to just the intake side of a gasoline engine can yield notable fuel economy benefits on FTP (Federal Test Procedure—USA) or NEDC (New European Driving Cycle) driving schedules, based on simulations and real vehicle testing. VVA when combined with Direct Injection (DI) in a gasoline engine can deliver even higher fuel efficiencies that are on par with diesel engines. The VVA/DI engine can become strategically important to America and other countries dependent on a gasoline-based transportation economy.

Likewise, the use of a continuously variable valvetrain for the intake side of a gasoline engine coupled with an Early Intake Valve Closing (EIVC) load control strategy can significantly lower engine-out NOx emissions by lowering an engine's effective compression ratio at light and moderate engine loads.

What is needed in the art is a simplified, inexpensive, and reliable system for varying the lift, duration, and timing of engine valves which employs relatively few moving parts and affords a relatively small packaging envelope in the engine compartment of a vehicle.

It is a principal object of the present invention to reduce the complexity, cost of manufacture, and difficulty of manufacture of a system for varying the lift, duration, and timing of engine valves.

It is a further object of the present invention to reduce the packaging envelope required for such a system relative to prior art systems.

SUMMARY OF THE INVENTION

Briefly described, a HELP system in accordance with the present invention defines a mechanical VVA device for scheduling poppet combustion valve lift events on an internal combustion engine. Designed for ease of manufacture and reduced cost, the device varies valve lift, duration, and phasing in a dependent manner for one or more banks of engine valves. Using a single electrical rotary actuator per bank of valves to control the VVA device, the lift events can be varied for either or both the exhaust or intake valves, depending on how many such systems are employed. The valve actuation energy comes from a conventional engine camshaft that is driven by a belt or chain. The controlling actuator, which may be powered electrically, may receive its energy from the engine's alternator.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Full Engine Load Operation

Figure 1:
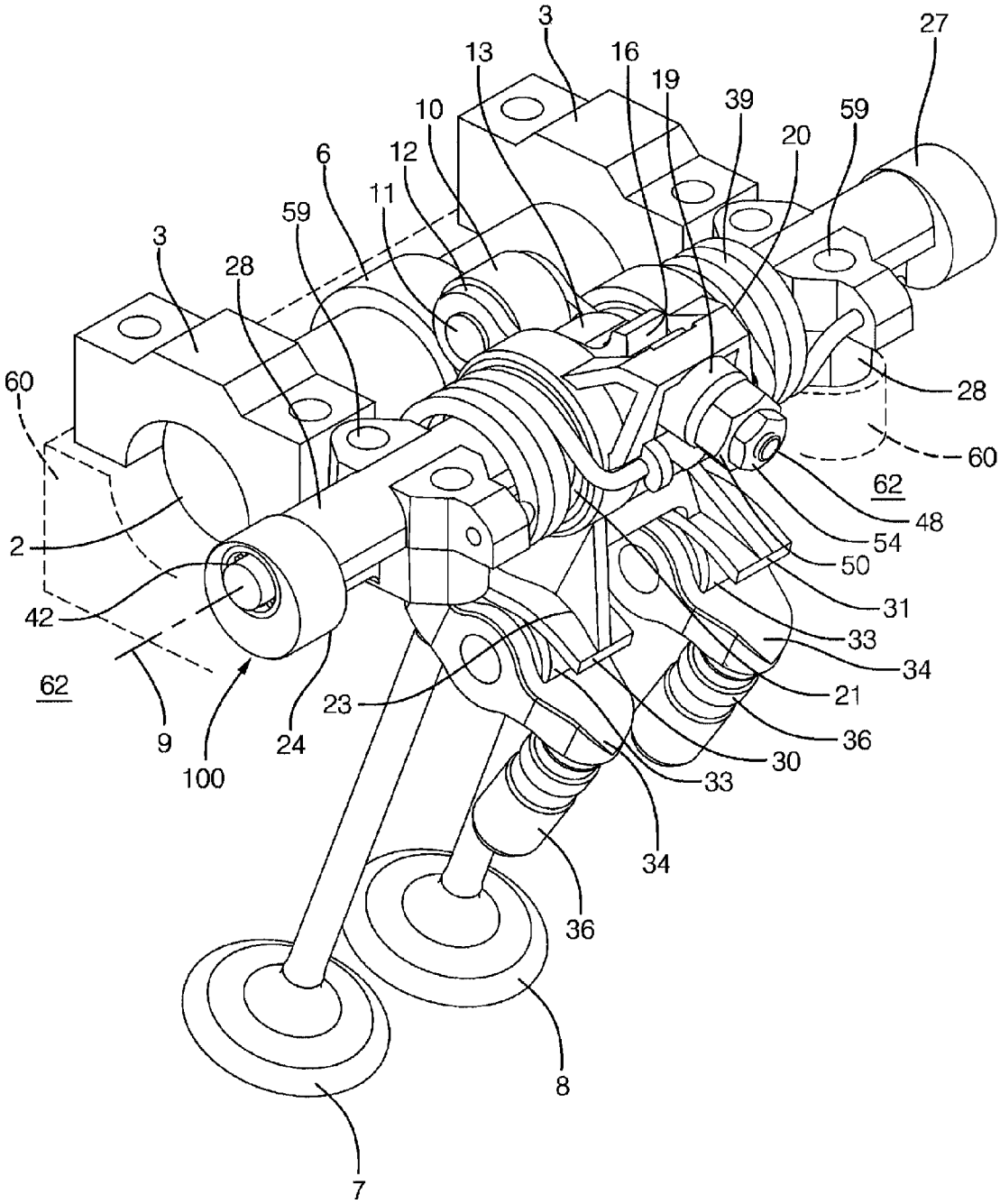
FIG. 1 is an isometric view showing an exemplary HELP system, in accordance with the present invention, on a dual valve assembly at a representative camshaft single lobe position.
Figure 2B:
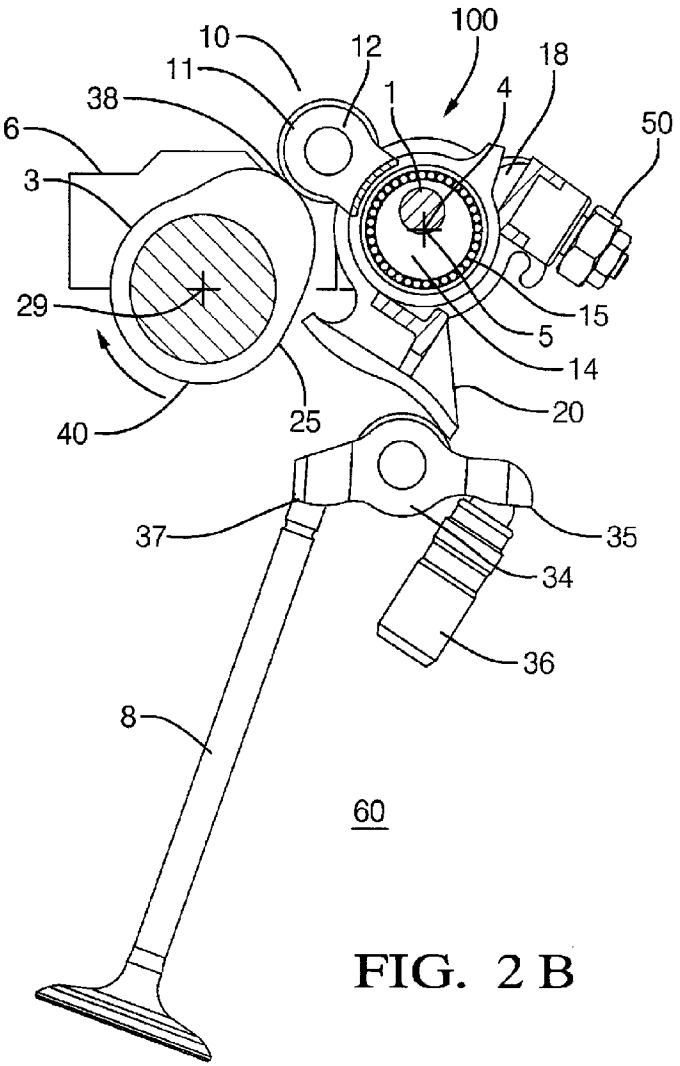
FIG. 2B is a cross-sectional elevational view of the HELP system in a high engine load mode, showing the rocker roller on the nose portion of the input camshaft.
Figure 2A:
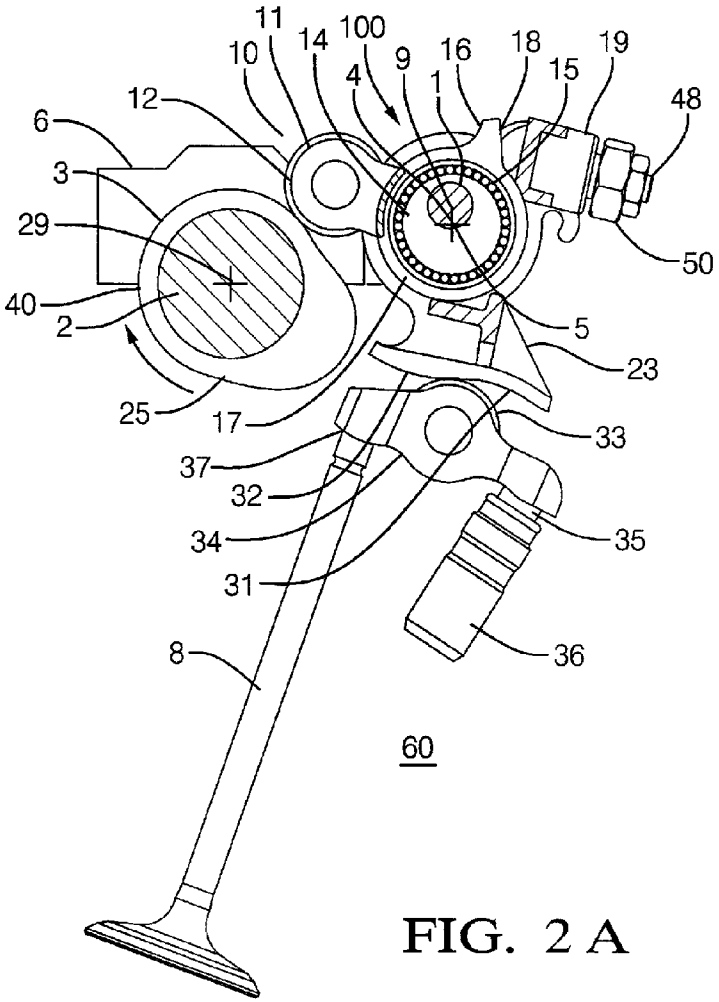
FIG. 2A is a cross-sectional elevational view of the HELP system in a high engine load mode, showing the rocker roller on the base circle portion of the input camshaft.
Figure 3B:
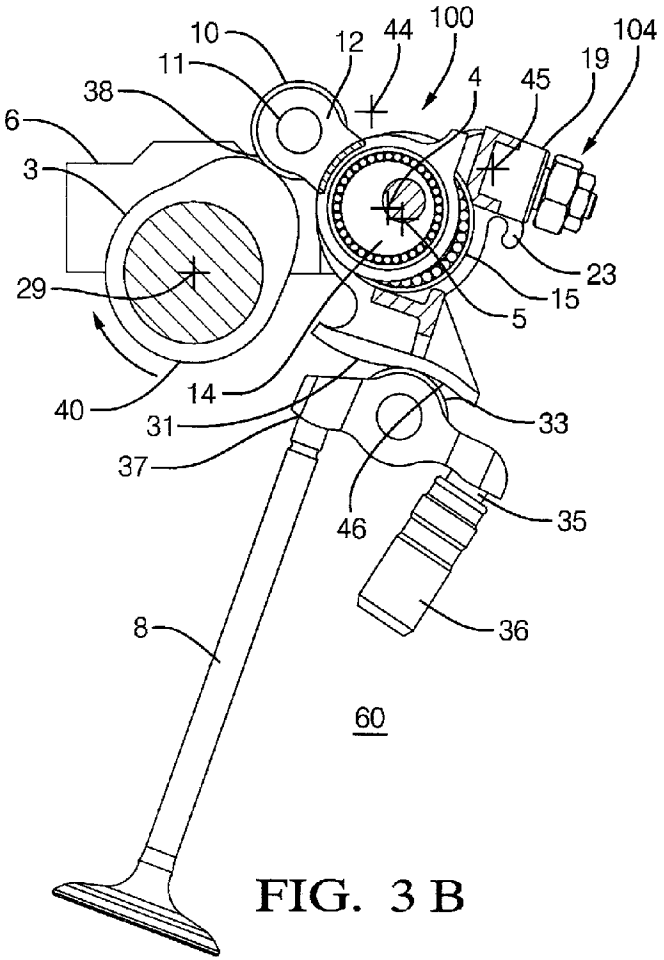
FIG. 3B is a cross-sectional elevational view of the HELP system in a low engine load mode, showing the rocker roller on the nose portion of the input camshaft.
Figure 3A:
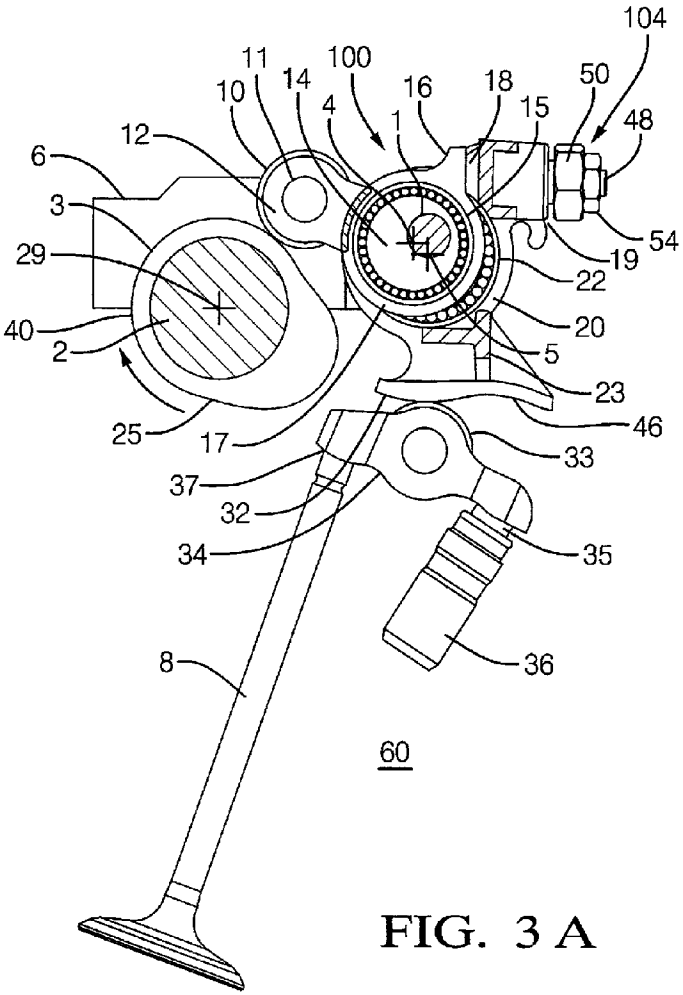
FIG. 3A is a cross-sectional elevational view of the HELP system in a low engine load mode, showing the rocker roller on the base circle portion of the input camshaft.

In FIGS. 1-3, a HELP VVA system 100 in accordance with the present invention is shown at one of the inner cylinder locations of a naturally aspirated, inline 4-cylinder gasoline engine. The combustion chambers are typically of the pent roof variety, with four valves per cylinder (two intake, two exhaust). HELP system 100, when applied to intake valves, manages an engine's intake gas exchange process with changes in the angular position of control shaft 1. In FIG. 2A and FIG. 2B, HELP system 100 is shown in a high engine load mode, and in FIG. 3A and FIG. 3B, the HELP system is shown in a low engine load mode. In each of these pairs of figures, a view of the mechanism with the input roller 10 on the base circle portion 40 of cam lobe 6 appears to the left (FIGS. 2A,3A), and a similar view with the input roller 10 on the nose portion 38 of cam lobe 6 (point of maximum lift) appears to the right (FIGS. 2B,3B). Also, note that the front input cam bearing 3, the front control shaft pivot housing 28, lash spring 39, and front output cam bearing 21, as shown in FIG. 1, have been omitted for clarity in explaining the operation of HELP system 100.

Referring to FIG. 1, axis of rotation 9 of control shaft 1 is centrically disposed in control shaft pivot housing 28 of internal combustion engine 62, for rotation of control shaft 1. Referring now to FIGS. 2A,2B, control shaft 1 is eccentrically fixed to eccentric control shaft disc 14 such that disc 14 rotates eccentrically about axis of rotation 9 when control shaft 1 is rotated. High engine load events as shown in FIGS. 2A,2B are produced by the mechanism whenever control shaft 1 is rotationally positioned such that the input rocker pivot center 4 (which is also the geometric center of disc 14) and output cam pivot center 5 are coincidental. At each engine cylinder is cam lobe 6 integral to nodular input camshaft 2, centered axially between two engine valves 7,8 for a given cylinder. A rocker roller 10, formed preferably of hardened steel, is free to rotate about a steel pin 11 staked in place within the input rocker clevis 12. As input camshaft 2 rotates clockwise, the opening flank 25 of cam lobe 6 pushes rocker roller 10 upward conventionally, causing input rocker subassembly 13 to rotate in a clockwise direction about disc 14 and about input rocker pivot center 4. As rocker subassembly 13 rotates, it turns about pivot center 4 of control shaft disc 14 via needle bearing 15.

Integral to input rocker subassembly 13 is a foot 16, formed preferably of cast steel, protruding from rocker bearing housing 17. Foot 16 engages an output cam shoe 18 contained in a boss feature 19 at the center of output cam subassembly 20, also formed preferably of cast steel. As input rocker subassembly 13 pivots clockwise about pivot center 4, foot 16 forces output cam subassembly 20 to also rotate clockwise about the fixed output cam pivot center 5. Rotation of output cam subassembly 20 is facilitated by front and rear output cam bearings 21,22 contained within output cam body 23. The fixed output cam pivot center 5 is located by cast inner races 24,27 of the control shaft pivot housings 28 that are bolted to cylinder head 60 of engine 62. In FIG. 1, two cast inner races disposed between inner races 24 and 27 are concealed by spring 39 and output cam subassembly 20.

Note that in the high engine load mode of control shaft 1, the input rocker and output cam subassemblies 13,20 move in unison on identical centers, that is to say, there is no relative motion between input rocker foot 16 and output cam shoe 18. Hence, in FIG. 2B, input cam lobe 6, input roller 10, input rocker subassembly 13, and output cam subassembly 20 act as a simple four-bar linkage, with respect to the virtual link that exists between fixed input camshaft pivot center 29 and fixed output cam pivot center 5.

Clockwise rotation of output cam subassembly 20 advances output cam profiles 30,31, ground into the output cam body 23, to where the radius of the output cam increases beyond that of the base circle portion 32 of the cam profile. The further that output cam subassembly 20 is rotated about the control shaft pivot housing inner races (only races 24 and 27 are visible), the greater the lift imparted through the finger follower rollers 33. The right end of each finger follower 34 pivots about the ball-shaped tip 35 of a conventional hydraulic valve lash adjuster 36 mounted in cylinder head 60. Pushing down on the centrally-located finger follower rollers 33 transmits lift to engine valves 7,8 via pallet 37 at the left ends of the finger followers 34.

Although the preferred embodiment described herein is depicted with low friction roller finger followers, using roller as a contact feature between output cam assembly 20 and finger follower 34, HELP system 100 is not limited to this type of a standard valvetrain. Another embodiment within the scope of the present invention may have crowned bucket type tappets (not shown here) with slightly different-shaped output cam profiles (not shown) as are known in the art.

When eccentric control shaft disc 14 is in the high engine load mode, as shown in FIGS. 2A and 2B, maximum lift is imparted to engine valves 7,8 whenever rocker roller 10 reaches the nose portion 38 of cam lobe 6. At this point, the input rocker and output cam subassemblies 13,20 cease to move in the clockwise direction. As input cam lobe 6 rotates further in the clockwise direction, nose portion 38 of lobe 6 slips past rocker roller 10, and lash spring 39 forces the output cam and input rocker subassemblies 20,13 to rotate counter-clockwise. This counter-clockwise rotation, in turn, reduces lift produced between the output cam profiles 30,31 and the finger follower rollers 33. Eventually, as camshaft 2 continues to rotate clockwise, rocker roller 10 reaches the base circle portion 40 of cam lobe 6 where lift remains at zero until the next engine event occurs for that cylinder.

Figure 4:
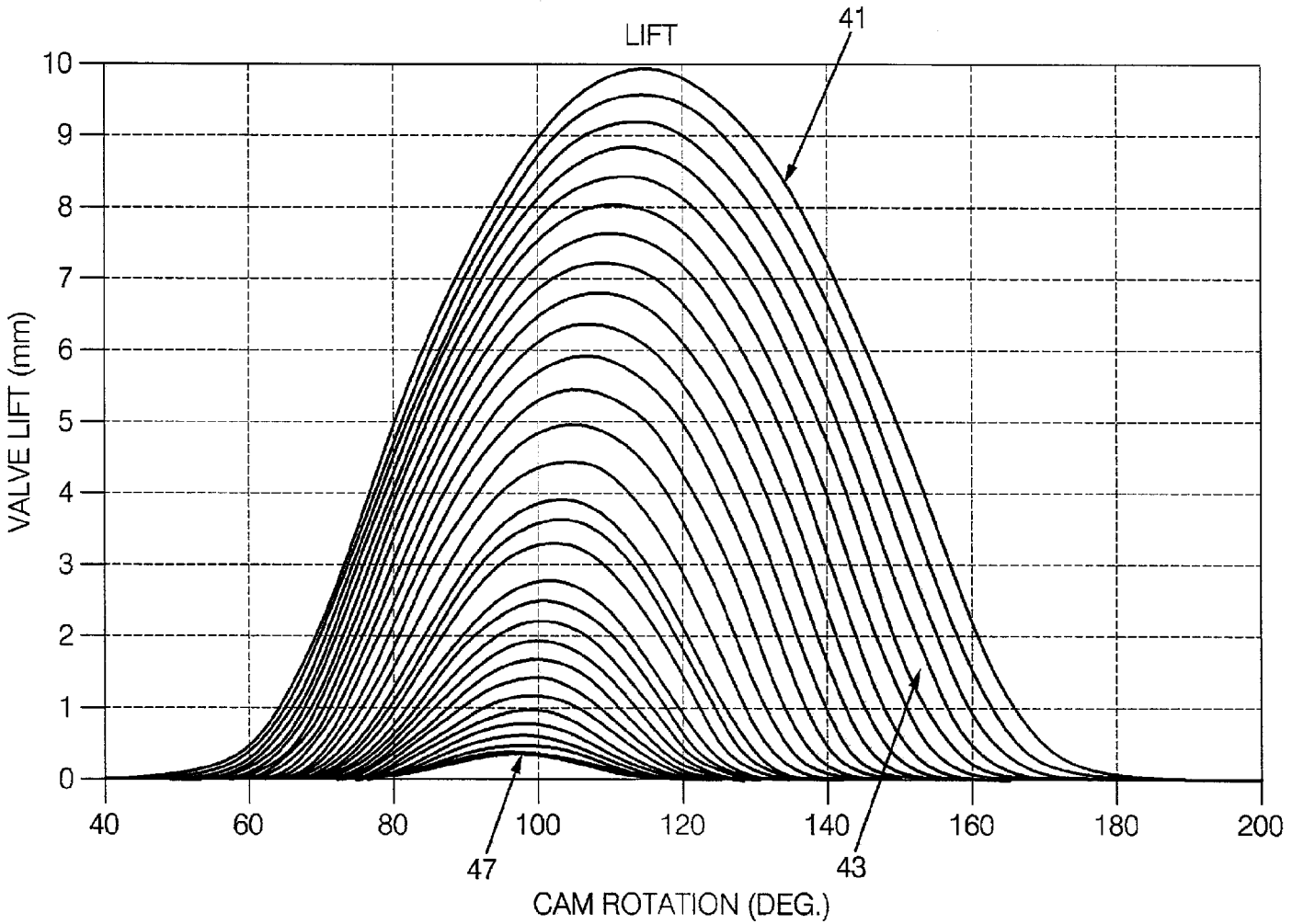
FIG. 4 is a family of representative cam timing, lift, and duration curves for a HELP system in accordance with the present invention.

The motion just described produces a peak lift profile similar to peak lift profile 41 shown in FIG. 4, to maximize gas flow to (intake valve) or from (exhaust valve) of engine 62.

Low Engine Load Operation

Referring now to FIGS. 3A,3B, control shaft 1 and the changing force load of the input rocker subassembly 13 are supported by bearings 42 (FIG. 1). An electromechanical actuator (not shown) operationally connected to control shaft 1 can change the angular position of control shaft 1 and eccentric control shaft disc 14 about the center of bearings 42 to vary engine load. Bearings 42 preferably are needle-type bearings, although dry-type sleeve bearings (not shown) may be used in some applications.

Referring to FIG. 2A through FIG. 3B, when control shaft 1 is rotated significantly clockwise relative to its high engine load mode position, HELP system 100 produces lower lift events (see region 43 in FIG. 4) with reduced duration, corresponding to lower engine loads. When this happens (FIGS. 3A,3B), input rocker pivot center 4 of control shaft disc 14 moves inward toward camshaft 2, away from the fixed pivot center 5 location of output cam subassembly 20. Thus, when input cam lobe 6 induces angular motion to the rocker subassembly 13, relative rolling and sliding motion results between input cam foot 16 and output cam shoe 18, since a second four-bar linkage is now created between the virtual ground link of input rocker pivot center 4 and output cam pivot center 5, the virtual link between input rocker pivot center 4 and the rocker foot is curvature center 44, the virtual link between foot curvature center 44 and the shoe curvature center 45, and the virtual link between shoe curvature center 45 and output cam pivot center 5.

Likewise, when control shaft assembly 1 is in the lowest engine load mode (FIGS. 3A,3B), finger follower rollers 33 spend most of their path on the base circle portion 32 of output cam profiles 30,31, just barely reaching the opening ramp 46 of the output cam profile, whenever the input rocker roller 10 is aligned with the nose portion 38 of cam lobe 6. Thus, HELP system 100 can generate a short and shallow lift event (curve 47 in FIG. 4), suitable for the lightest of all engine loads.

It will be observed that displacement of the control shaft position from that shown in FIGS. 2A,2B to that shown in FIGS. 3A,3B serves a) to advance the position of input roller 10 on cam lobe 6, thereby advancing the start of valve opening, and b) to advance the contact point of profile 30 or 31 with finger roller 33, thereby reducing the potential valve lift. Thus, varying the angular position of control shaft 1 between the high engine load position illustrated in FIGS. 2A,2B and the low engine load position just described for FIGS. 3A,3B produces the entire lift curve family depicted in FIG. 4.

Special Features

One novel feature of HELP system 100 is elimination of relative motion between input rocker foot 16 and output cam shoe 18 when the control shaft is in the high engine load lift mode. Since both rocker pivot center 4 and output cam pivot center 5 are coincidental at high load lift mode, there is also no relative angular motion between the foot 16 of input rocker subassembly 13 and shoe 18 of output cam assembly 20, respectively). This makes the high load lift cam profile design fairly straight forward from a kinematic standpoint.

Figure 5:
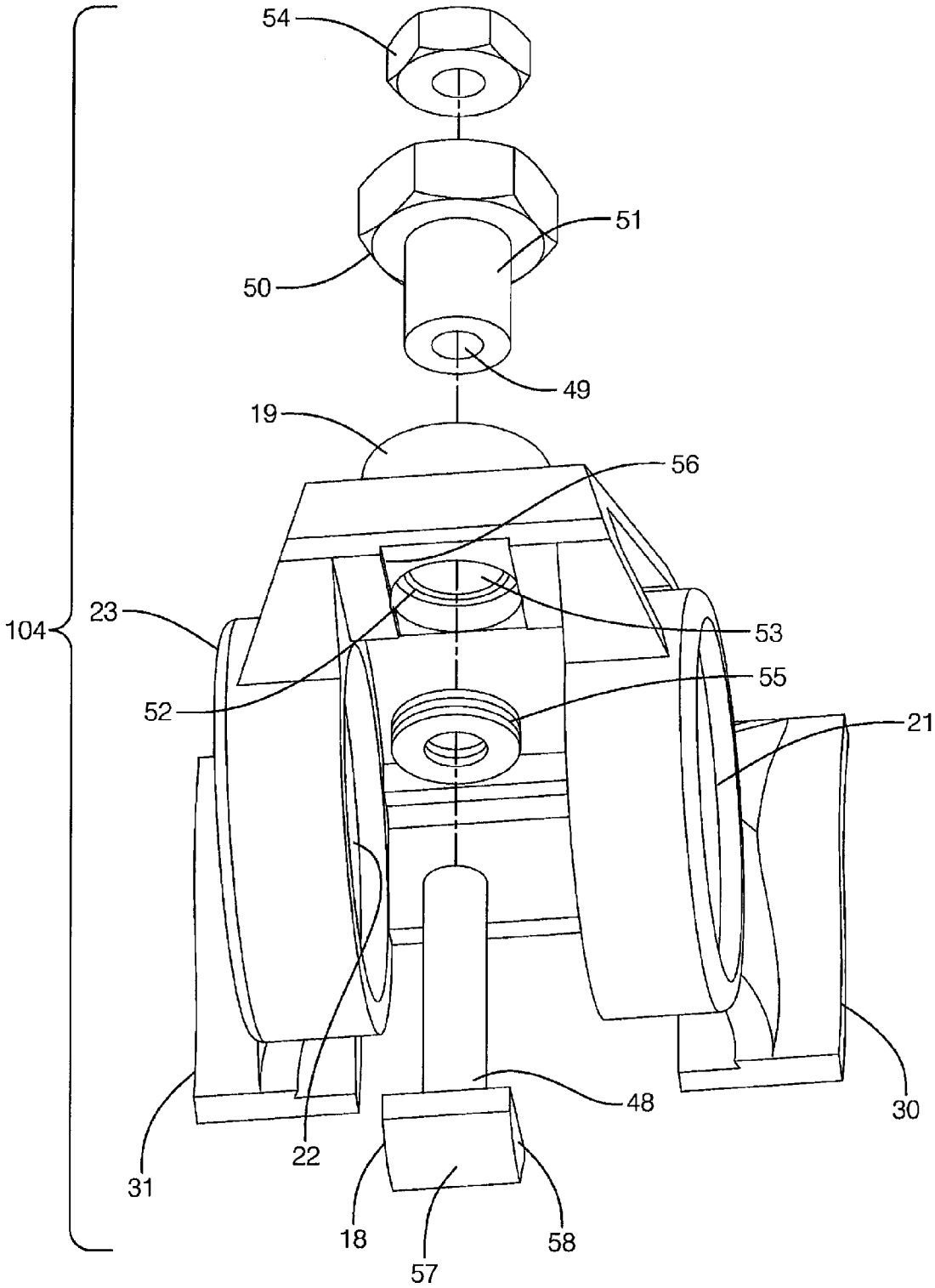
FIG. 5 is an exploded isometric drawing of a lifter adjuster assembly for use in the HELP system shown in FIGS. 1-3.

A second important improvement is the convenient lift adjuster as shown in FIG. 5. In a prior art EIVC throttleless-load control scheme, small lift variations from one cylinder to the next can substantially affect engine stability at light loads such as idle. For instance, at a light load, a global lift command of 2 mm might be issued by the engine controller. If a prior art VVA system delivers the correct 2 mm valve lift profiles to three of the cylinders, but a 0.5 mm lift error occurs at the fourth cylinder, a significant gas flow error will result. However, the same 0.5 mm lift error at a full load lift of 10 mm in a conventionally-throttled system would have little noticeable effect at the same idle load.

The lift adjuster shown in FIG. 5 includes lift adjuster mechanism 104, in an exploded view. The previously described output cam shoe 18 includes a threaded stud 48, welded to a hardened, wear resistant pad 57, ground to a precise curvature. Right hand external threads (not shown) on stud 48 are provided at X threads per inch. Correspondingly, the inner diameter of adjusting screw 50 also contains internal threads 49 of the same pitch. The outer diameter of adjusting screw 50, however, has external right hand threads 51 with a pitch of preferably about X+1 threads per inch. Likewise, bore 52 in boss feature 19 of the output cam body 23 contains right handed, internal threads 53 that have the X+1 pitch, and jam nut 54 contains internal right handed threads of X pitch.

During the final assembly of the output cam, the diameter of stud 48 of shoe 18 is loosely inserted through one or more Belleville washers 55 into larger bore 52 in boss feature 19 of output cam body 23. Next, the internal 49 and external 51 threads of adjusting screw 50 are simultaneously engaged over threaded stud 48 of shoe 18 and into internal threads 53 of boss feature 19, respectively. Since the two pitches vary by only one thread per inch, several turns of adjuster screw 50 are required to seat output cam shoe 18 fully against Belleville washers 55 into output cam body 23. Flats 56 machined into output cam body 23 mate with flat sides 58 of pad 57 of output cam shoe 18 to keep it from turning as Belleville washers 55 are loaded. Lastly, jam nut 54 is screwed on over threaded stud 48 of output cam shoe 18 and tightened against adjusting screw 50 to lock the adjuster against engine vibrations.

After input camshaft 2 and cam bearings 3 are installed on cylinder head 60 that has been bolted to engine 62, the completed HELP system 100 is lowered onto the head and bolted down with fasteners (not shown) through bores 59 in control shaft pivot housings 28.

A cylinder head 60 equipped with HELP system 100 provides an engine manufacturer with several options to balance the cylinder-to-cylinder gas flow. The HELP system lift adjustment provision provides a unique flexibility to choose the best method. Gas flow can be adjusted either on an individual cylinder head in a flow chamber environment, or on a completed running engine.

Assembly line calibration typically occurs at an automated test stand, with either a precision air flow rate meter for calibrating individual completed cylinder heads, or with a bench type combustion gas analyzer for calibrating fully assembled engines. For balancing individual cylinder heads, lift can be adjusted either statically to match a desired steady-state, steady-flow-rate target with the camshaft fixed, or dynamically with the camshaft spinning, by measuring the time-averaged flow rate for each cylinder. However, HELP system 100 can also be adjusted dynamically in a repair garage with a running engine, using cylinder-to-cylinder exhaust gas analysis techniques with a portable fuel-to-air ratio analyzer.

Referring again to FIG. 1, to make a lift adjustment, jam nut 54 is loosened with a first wrench while holding adjusting screw 50 in position with a second wrench. Once jam nut 54 is loosened 2-3 revolutions, the second wrench can be used to adjust the lift simultaneously at engine valves 7,8.

Relative to the contact face of foot 16, adjusting screw 50 is rotated counter-clockwise to increase lift. This causes adjusting screw 50 to pull away from boss feature 19 of output cam subassembly 20 and input camshaft 2. Since output cam shoe 18 is constrained from rotating by the flats 56 machined into the output cam body, it is also pushed away from adjusting screw 50. But the difference in thread pitches causes adjusting screw 50 to pull away from output cam subassembly 20 more slowly than output cam shoe 18 is pushed away from adjuster screw 50, ultimately causing output cam shoe 18 to be pushed farther away from output cam subassembly 20. If the engine is not running and the rotary position of control shaft 1 is fixed, the resultant motion of the output cam shoe 18 with respect to output cam subassembly 20 causes output cam subassembly 20 to rotate clockwise relative to the input rocker subassembly 13. This in turn increases lift at valves 7,8.

However aggressive the cam profiles 30,31 are, a careful selection of the threaded pitch "X" in the adjuster parts can yield as little as a 100 micron lift change at valves 7,8 for every revolution of adjuster screw 50 for each of the individual cylinders of engine 62. This is an ideal flow adjustment resolution for balancing the gas flow across all the cylinders.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A variable valvetrain actuation device coupled to a camshaft lobe and a follower for actuating a combustion valve in an internal combustion engine, said device comprising:

a control shaft having an axis of rotation and rotatably mounted to said engine, said control shaft fixed to a control shaft disc, said disc having a pivot center eccentric to said control shaft axis of rotation;

an input rocker subassembly pivotably disposed on said control shaft disc, said input rocker subassembly having a contact feature disposed against said camshaft lobe, having a foot defined by said input rocker subassembly and having an input rocker pivot center coincident with said control shaft disc pivot center;

an output cam subassembly pivotably mounted to said engine and engageable by said foot, said output cam assembly having an output cam profile for engaging said follower, an output cam pivot center locationally fixed with respect to said control shaft axis of rotation, a threaded bore having X threads per inch, and a shoe engageable by said foot of said input rocker subassembly, wherein when said control shaft is rotated about its axis of rotation, said input rocker pivot center is movable relative to said output cam pivot center; and an adjuster mechanism for varying the angular relationship of said input rocker subassembly to said output cam subassembly;

wherein said adjuster mechanism comprises:

a threaded stud defined by said shoe, said threaded stud having Y threads per inch; and an adjusting screw having internal threads and external threads wherein said adjusting screw internal threads are matable with said threads of said threaded stud and wherein said external threads are matable with said threaded bore of said output cam subassembly and wherein X does not equal Y numerically.

2. A variable valvetrain actuation device coupled to a camshaft lobe and a follower for actuating a combustion valve in an internal combustion engine, said device comprising:

a control shaft having an axis of rotation and rotatably mounted to said engine, said control shaft fixed to a control shaft disc, said disc having a pivot center eccentric to said control shaft axis of rotation;

an input rocker subassembly pivotably disposed on said control shaft disc, said input rocker subassembly having a contact feature disposed against said camshaft lobe, having a foot defined by said input rocker subassembly and having an input rocker pivot center coincident with said control shaft disc pivot center; and an output cam subassembly pivotably mounted to said engine and engageable by said foot, said output cam assembly having an output cam profile for engaging said follower and having an output cam pivot center locationally fixed with respect to said control shaft axis of rotation, wherein when said control shaft is rotated about its axis of rotation, said input rocker pivot center is movable relative to said output cam pivot center;

wherein a maximum valve lift mode is defined when said input rocker pivot center is coincident with said output cam pivot center.

3. A device in accordance with claim 2 further comprising a bias spring adapted for urging said output cam assembly toward said foot.

4. A device in accordance with claim 2 further comprising an adjuster mechanism for varying the angular relationship of said input rocker subassembly to said output cam subassembly.

5. A device in accordance with claim 4 wherein said varying in a first direction increases at least one of a lift and a duration of opening of said valve, and wherein said varying in a second and opposite direction decreases at least one of said lift and said duration of opening of said valve.

6. A device in accordance with claim 4 wherein said output cam subassembly includes a threaded bore having X threads per inch and a shoe engageable by said foot of said input rocker subassembly, and wherein said adjuster mechanism comprises:

a threaded stud defined by said shoe, said threaded stud having Y threads per inch; and an adjusting screw having internal threads and external threads wherein said adjusting screw internal threads are matable with said threads of said threaded stud and wherein said external threads are matable with said threaded bore of said output cam subassembly and wherein X does not equal Y numerically.

7. A device in accordance with claim 2 wherein said engine includes a control shaft housing and wherein said control shaft is rotatably mounted and said output cam subassembly is pivotably mounted to said control shaft housing.

8. A device in accordance with claim 2 wherein a high lift event with full duration is produced whenever said control shaft is rotationally aligned such that said input rocker pivot center and said output cam pivot center are coincidental.

9. A variable valvetrain actuation device coupled to a camshaft lobe and a follower for actuating a combustion valve in an internal combustion engine, said device comprising:

a control shaft having an axis of rotation and rotatably mounted to said engine, said control shaft fixed to a control shaft disc, said disc having a pivot center eccentric to said control shaft axis of rotation;

an input rocker subassembly pivotably disposed on said control shaft disc, said input rocker subassembly having a contact feature disposed against said camshaft lobe, having a foot defined by said input rocker subassembly and having an input rocker pivot center coincident with said control shaft disc pivot center; and an output cam subassembly pivotably mounted to said engine and engageable by said foot, said output cam assembly having an output cam profile for engaging said follower and having an output cam pivot center locationally fixed with respect to said control shaft axis of rotation, wherein when said control shaft is rotated about its axis of rotation, said input rocker pivot center is movable relative to said output cam pivot center;

wherein a high lift event with full duration is produced whenever said control shaft is rotationally aligned such that said input rocker pivot center and said output cam pivot center are coincidental.

10. A device in accordance with claim 9 further comprising a bias spring adapted for urging said output cam assembly toward said foot.

11. A device in accordance with claim 9 further comprising an adjuster mechanism for varying the angular relationship of said input rocker subassembly to said output cam subassembly.

12. A device in accordance with claim 11 wherein said output cam subassembly includes a threaded bore having X threads per inch and a shoe engageable by said foot of said input rocker subassembly, and wherein said adjuster mechanism comprises:

a threaded stud defined by said shoe, said threaded stud having Y threads per inch; and an adjusting screw having internal threads and external threads wherein said adjusting screw internal threads are matable with said threads of said threaded stud and wherein said external threads are matable with said threaded bore of said output cam subassembly and wherein X does not equal Y numerically.

13. A device in accordance with claim 11 wherein said varying in a first direction increases at least one of a lift and a duration of opening of said valve, and wherein said varying in a second and opposite direction decreases at least one of said lift and said duration of opening of said valve.

14. A device in accordance with claim 9 wherein a maximum valve lift mode is defined when said input rocker pivot center is coincident with said output cam pivot center.

15. A device in accordance with claim 9 wherein said engine includes a control shaft housing and wherein said control shaft is rotatably mounted and said output cam subassembly is pivotably mounted to said control shaft housing.

16. An internal combustion engine having a camshaft lobe and a follower for actuating a combustion valve, including a variable valvetrain actuation device, wherein said device comprises:

a control shaft having an axis of rotation and rotatably mounted to said engine, said control shaft fixed to a control shaft disc, said disc having a pivot center eccentric to said control shaft axis of rotation;

an input rocker subassembly pivotably disposed on said control shaft disc, said input rocker subassembly having a contact feature disposed against said camshaft lobe, having a foot defined by said input rocker subassembly and having an input rocker pivot center coincident with said control shaft disc pivot center; and an output cam subassembly pivotably mounted to said engine and engageable by said foot, said output cam subassembly having an output cam profile for engaging said follower and having an output cam pivot center locationally fixed with respect to said control shaft axis of rotation, wherein when said control shaft is rotated about its axis of rotation, said input rocker pivot center is movable relative to said output cam pivot center;

wherein a maximum valve lift mode is defined when said control shaft is adapted to align said input rocker pivot center and said output cam pivot center.

17. An internal combustion engine in accordance with claim 16 having a plurality of camshaft lobes and a plurality of followers for actuating a plurality of combustion valves at a plurality of combustion cylinders by a plurality of variable valvetrain actuation devices, each of said devices further comprising an adjuster mechanism, wherein each of said devices at each of said cylinders is individually adjustable to vary the lift height and lift duration of the associated combustion valve.

18. An internal combustion engine in accordance with claim 16 further comprising an adjuster mechanism for varying the angular relationship of said input rocker subassembly to said output cam assembly.

19. An internal combustion engine in accordance with claim 16 wherein said engine includes a control shaft housing and wherein said control shaft is rotatably mounted and said output cam subassembly is pivotably mounted to said control shaft housing.

* * * * *